US007523595B2

(12) United States Patent
Klar

(10) Patent No.: US 7,523,595 B2
(45) Date of Patent: Apr. 28, 2009

(54) METHOD FOR ATTACHING A DRAW STRING TO AN INFUSION BAG AUTOMATICALLY

(75) Inventor: Paul Gerhard Klar, Wasserburg (DE)

(73) Assignee: Haussier & Sauter KG, Kressbronn (DE)

( * ) Notice: Subject to any disclaimer, the term of this patent is extended or adjusted under 35 U.S.C. 154(b) by 661 days.

(21) Appl. No.: 11/248,640

(22) Filed: Oct. 12, 2005

(65) Prior Publication Data

US 2007/0092606 A1 Apr. 26, 2007

(51) Int. Cl.
*B65B 29/04* (2006.01)

(52) U.S. Cl. ..... 53/413; 53/134.2; 426/77; 426/79; 426/80; 426/83

(58) Field of Classification Search ..... 53/413, 53/436, 134.2; 426/77, 79, 80, 83
See application file for complete search history.

(56) References Cited

U.S. PATENT DOCUMENTS

| | | | | |
|---|---|---|---|---|
| 2,881,910 | A * | 4/1959 | Murphy | 426/80 |
| 5,632,132 | A * | 5/1997 | Kuipers et al. | 53/413 |
| 5,878,550 | A * | 3/1999 | Cahill et al. | 53/413 |
| 5,979,144 | A * | 11/1999 | Bailey et al. | 53/413 |
| 6,206,256 | B1 | 3/2001 | Marzocchi | |
| 6,499,273 | B1 | 12/2002 | Marzocchi | |
| 6,746,699 | B2 * | 6/2004 | Lohrey et al. | 426/83 |
| 2001/0007688 | A1 * | 7/2001 | Klar | 426/80 |
| 2004/0071830 | A1 | 4/2004 | Klar | |

FOREIGN PATENT DOCUMENTS

| | | |
|---|---|---|
| DE | 299 05 470 | 10/2000 |
| EP | 0 807 579 | 11/1997 |
| EP | 0 850 847 | 7/1998 |
| EP | 0 691 268 | 9/1998 |
| EP | 1 116 671 | 8/2003 |
| EP | 1 273 529 | 12/2003 |
| GB | 809573 | 2/1959 |
| WO | WO 95/10462 | 4/1995 |
| WO | WO 99/03734 | 1/1999 |
| WO | WO 01/34486 | 5/2001 |

* cited by examiner

*Primary Examiner*—Hemant M Desai
(74) *Attorney, Agent, or Firm*—Pandiscio & Pandiscio

(57) ABSTRACT

A method for automatically attaching a draw string to an infusion bag, in which the draw string surrounds the infusion bag.

14 Claims, 10 Drawing Sheets

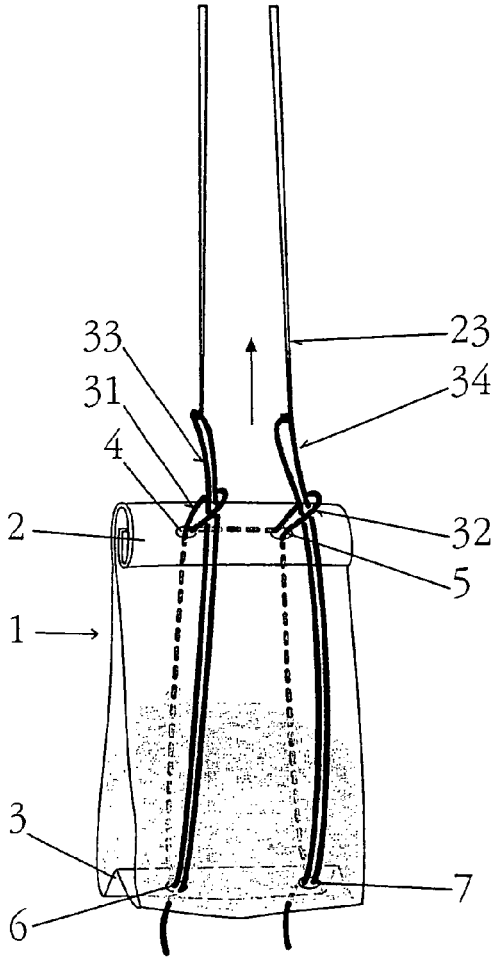
Fig.7
Fig.8
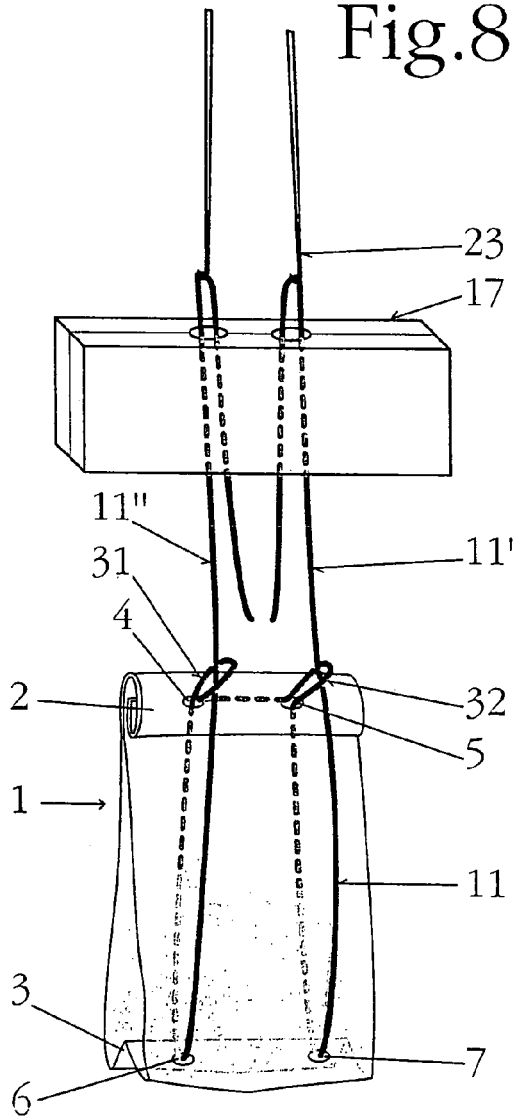

METHOD FOR ATTACHING A DRAW STRING TO AN INFUSION BAG AUTOMATICALLY

BACKGROUND OF THE INVENTION

1. Field of the Invention

The present invention relates to a method for attaching a draw string to an infusion bag automatically, in which the draw string for squeezing the infusion bag surrounds the infusion bag longitudinally in two laterally offset layers, with the draw string being doubled in each case and inserted through two openings provided in the top part and formed into a loop on one side of the infusion bag, the one section of the draw string leading from each loop is looped around the infusion bag, passed back through the loop and forms a draw section for squeezing the infusion bag and both loops are connected together by means of an intermediate piece in contact with the top part of the infusion bag.

2. Description of the Prior Art

An infusion bag of this type is disclosed in EP 1 273 529 A1. This publication, however, does not disclose which process steps are required in order to pull the draw thread through the individual openings and loop it around the infusion bag in an economical manner.

SUMMARY OF THE INVENTION

The purpose of the present invention is therefore to create a method for attaching a draw string to an infusion bag automatically by means of which infusion bags of this type can be manufactured automatically and inexpensively involving only a few process steps. The complexity of the machine required to achieve this should be kept low, and also all malfunctions in the adjustment of the draw string should be avoided to a large extent. Rather, it should be possible for the individual successive adjustment movements of the adjusting elements acting on the draw string to be performed in a straightforward manner, nevertheless at all times it should be guaranteed that the draw string remains securely held in the area of the infusion bag and that the infusion bag is almost completely squeezed out.

In accordance with the present invention, the method for attaching a draw string to an infusion bag automatically is characterised in that the draw string is initially aligned in a U-shape on one side of the infusion bag at least up to the height of the openings in the top part and is passed through the openings as loops to the other side, that two further loops are then formed in the area of the base of the infusion bag and run in approximately the same way as the loops formed in the area of the top part, and that after this the loops assigned to the base of the infusion bag are passed through the loops held in the top part and are drawn up in order to form the draw sections.

In this case, it is advantageous for the U-shape of the draw string to be made using a slider adapted to the lateral distance between the two openings provided in the top part of the infusion bag, a draw section or a similar guide element, by means of which the draw string can be deflected between preferably two laterally arranged guide rollers in the direction of the infusion bag.

The loops assigned to the base of the infusion bag can be formed in a simple manner with the help of two openings worked into the area of the base of the infusion bag or by means of one or two guide elements arranged at a distance from the base, with the draw string being passed through the guide elements or in between them and the base and the loops formed in the area of the base of the infusion bag can be formed with the help of a roller or the like as a guide element, the roller being arranged at a distance from the base with each of the draw strings being passed between the roller and the base.

In loops formed with the help of a roller as the guide element, the draw string in the area of the base should be guided in cuts worked into or formed into the base.

It is economical for the loops assigned to the top part and the base of the infusion bag each to be formed by a separate adjusting element, e.g. in the form of a double needle and for the loops assigned to the top part of the infusion bag to be held in place by an adjusting element during formation of the loops assigned to the base, this adjusting element having to be passed through the loops formed in the top part.

A particularly simple loop can be achieved if the adjusting element used for forming the loops that pass through the top part of the infusion bag is moved to the area of the base, in a preferred embodiment is swivelled and there is released from the loops and that, after this, the loops are formed in the area of the base using this adjusting element. In this procedure, it is only necessary to have one adjusting element configured as a double needle for forming the loops.

In order to jointly form the loops that pass through the top part and the loops provided in the area of the base, however in order to avoid tangles, two laterally offset hook needles can also be provided that, during the forming of the loops in the area of the base, are twisted, in a preferred embodiment, into a space in the loops assigned to the top part.

One or both draw sections of the draw string can be provided with tags or the like, in a preferred embodiment in the end parts of the draw sections.

To facilitate transport of the infusion bag, it is furthermore advantageous for the draw string surrounding the infusion bag to be tensioned after the tag has been attached, for example with the help of an adjustable roller, in such a way that the tag is in contact with the top part of the infusion bag.

This can be done in such a way that surplus parts of the draw string are stored in the infusion bag or between two chambers after the infusion bag has been squeezed using an adjustable slider or a roller.

Furthermore, it is advantageous for the two loops formed in the area of the base of the infusion bag to be guided in a block or the like when the loops are pulled tight.

If infusion bags are produced using the method in accordance with the present invention, this not only guarantees that each infusion bag will be surrounded by two loops aligned in the intended areas in order to squeeze it out but also, above all, that it is possible to manufacture the loops in a short time automatically and economically without any disruptions in the operating sequence. Due to the small number of process steps involved, and the fact that the adjusting elements are almost always adjusted in a straight line, it is therefore assured that excess strains on the draw string, for example at changes of direction, are excluded, which means that the draw string is not damaged and that interruptions in operation do not have to be accepted.

Furthermore, the construction complexity for operating the adjusting elements configured as hook needles, double needles or sliders by means of pulling or pushing forces is slight, while the adjusting elements can also be adjusted and controlled without difficulty, therefore it is easy and inexpensive to loop draw strings around infusion bags. The process in accordance with the present invention consequently makes it possible to manufacture infusion bags with two loops without difficulty.

BRIEF DESCRIPTION OF THE DRAWINGS

The drawings show the processing sequence by means of which a draw string must be adjusted in the individual sections in order to put two loops around an infusion bag. In the drawings, FIG. 7 shows the loops that pass through the base being threaded through the loops of the top part, FIG. 8 shows the subsequent forming of the loops of the base into draw sections.

DESCRIPTION OF THE PREFERRED EMBODIMENTS

Figure 1:
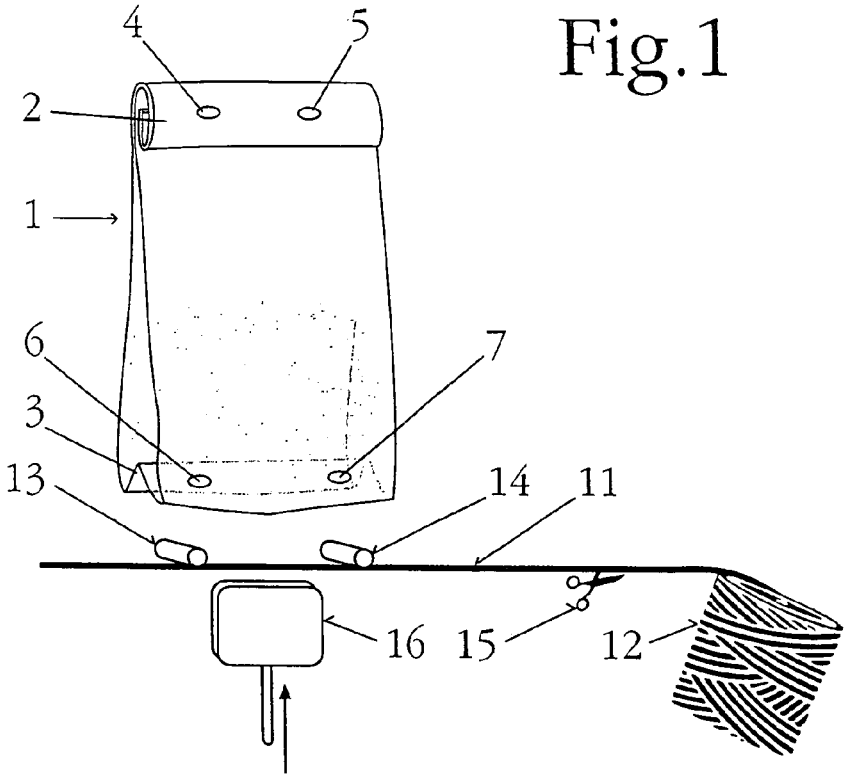
FIG. 1 shows the starting position of the infusion bag and of the draw string to be looped around it.
Figure 2:
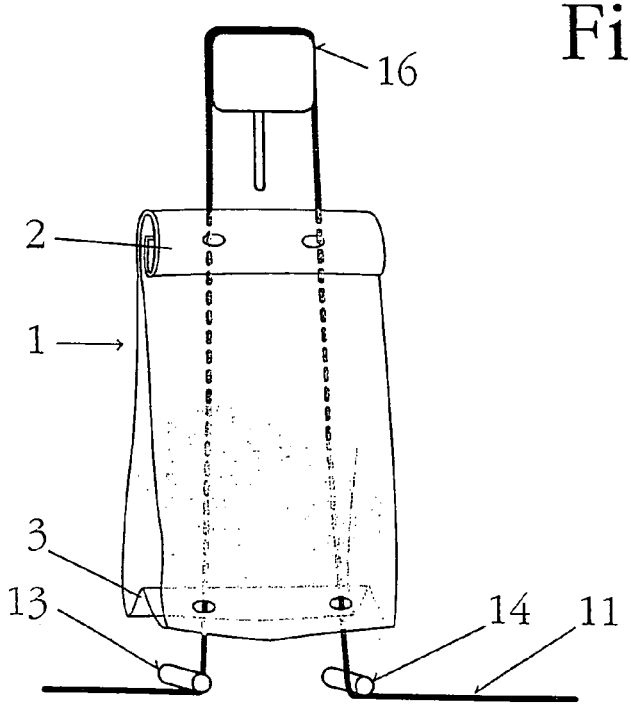
FIG. 2 shows the alignment of the draw string by means of a slider.

The infusion bag identified with 1 and shown in whole or in part in FIGS. 1 to 20, including in different embodiments, is used for holding tea or a similar product which has to be steeped in order to produce a drink, and has a top part 2 and a base 3 into which openings 4 and 5 or 6 and 7 are punched during the processing or are worked in during a previous step in order to be able to accommodate a draw string 11 in a defined position. With the help of the draw string 11 which is looped around the infusion bag 1 twice, it is possible to squeeze out the infusion bag 1 almost completely.

The draw string 11 is stored on a roller 12, is cut to the correct length by means of a shear 15 and is looped around the infusion bag 1 in accordance with the following process steps and then finally has a label 10 attached to it. First of all, the draw string 11 is aligned underneath the infusion bag 1 (FIG. 1) and is then moved into the position shown in FIG. 2 by means of a slider 16. With the assistance of two rollers 13 and 14 arranged at a distance from one another, the draw string 11 is aligned on the back of the infusion bag 1 in such a way that the draw string 11 runs at the level of the openings 4 and 6 or 5 and 7.

Figure 3:
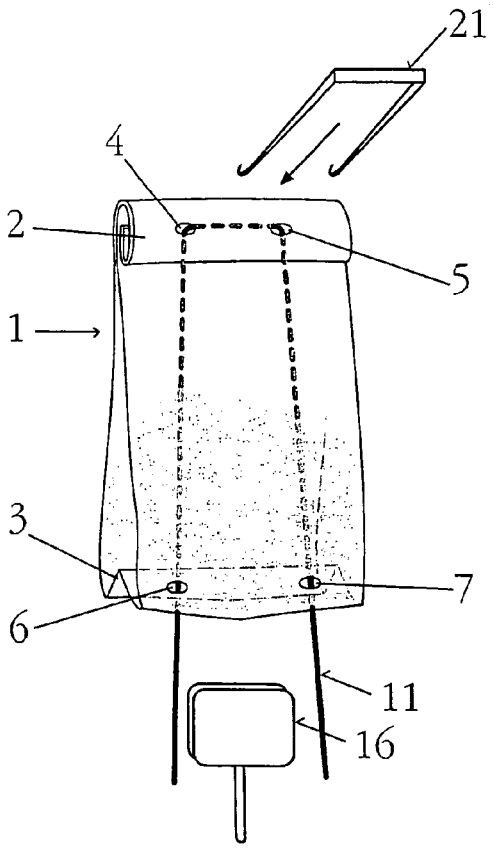
FIG. 3 shows the adjustment of an adjusting element for forming the loops that pass through the top part.
Figure 4:
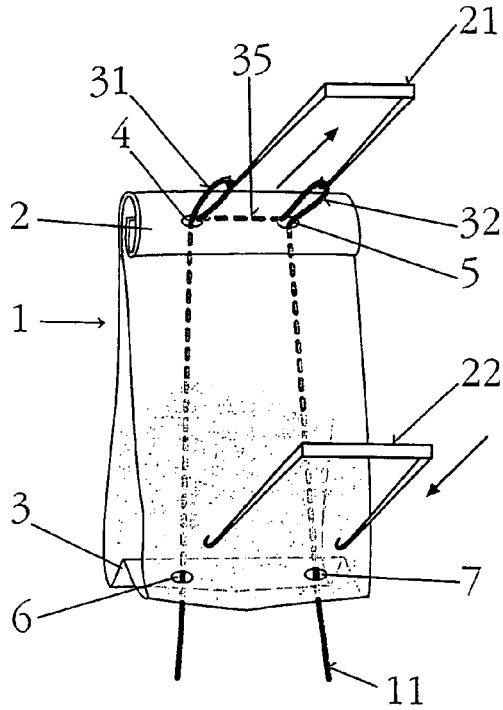
FIG. 4 shows the forming of the loops assigned to the top part as well as the feed movement of an adjusting element for forming the loops that pass through the base.
Figure 5:
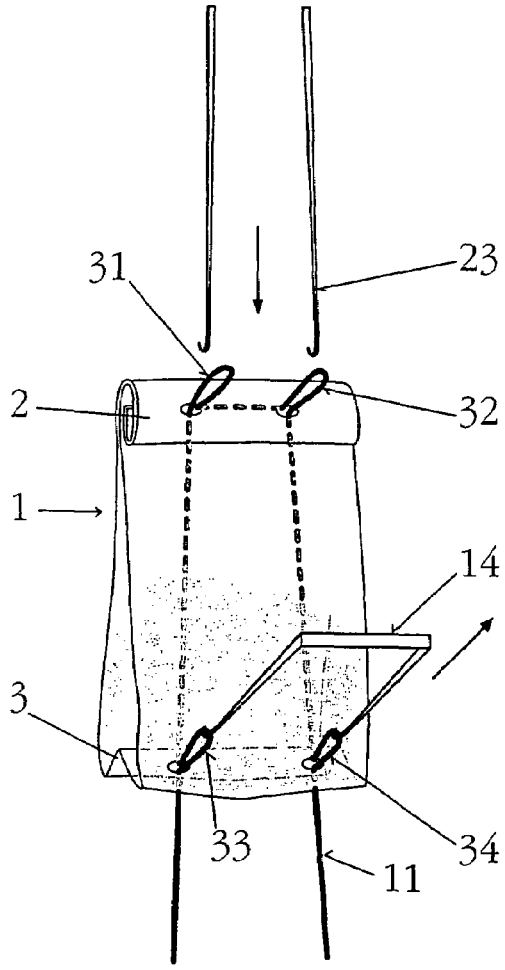
FIG. 5 shows the forming of the loops assigned to the base as well as the feed movement of another adjusting element.
Figure 6:
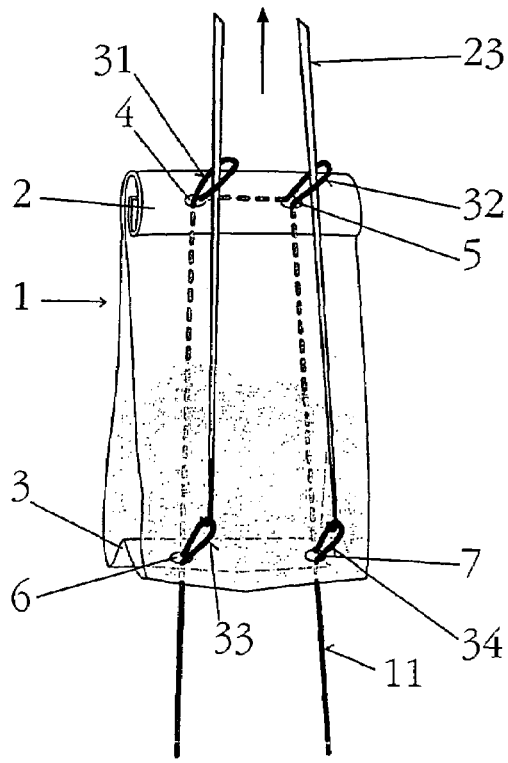
FIG. 6 shows the insertion of the third adjusting element into the loops that pass through the top part and the pickup of the loops that pass through the base.
Figure 9:
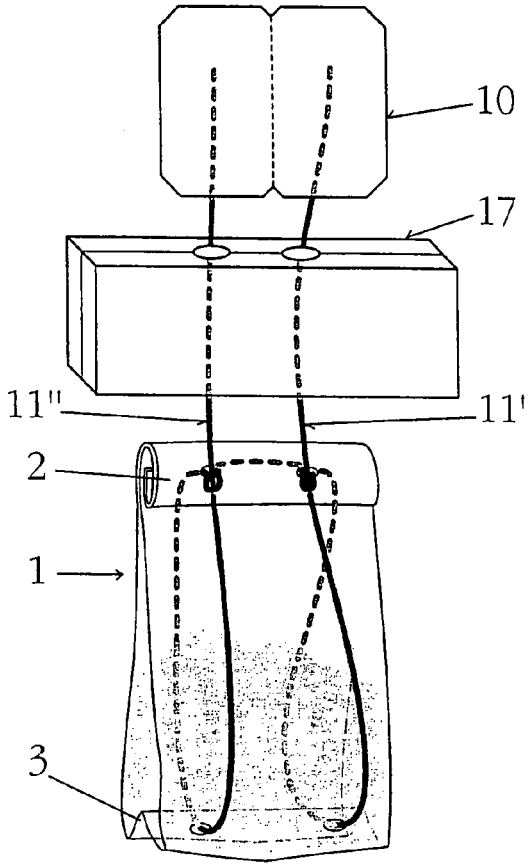
FIG. 9 shows the attachment of a label onto the formed draw sections.

Next, as shown in FIGS. 3, 4 and 5, a first adjusting element 21 and a second adjusting element 22 that are formed as a double needle are used for forming loops 31 and 32 or 33 and 34. The loops 31 and 32 are connected together by means of an intermediate piece 35 touching the infusion bag 1 and pass through the openings 4 or 5 provided in the top part 2, while the loops 33 and 34 pass through the openings 6 and 7 provided in the base 3. By means of a third adjusting element 23 that is also formed as a double needle and through which loops 31 and 32 are passed, the loops 33 and 34 are picked up in accordance with FIG. 6 and are pulled through the loops 31 or 32 in accordance with FIG. 7. Next, the loops 33 and 34, that are guided by a block 17, are pulled on in such a way that these parts of the draw string 11 form two draw sections 11' and 11" to which the label 10 is to be attached.

Figure 10:
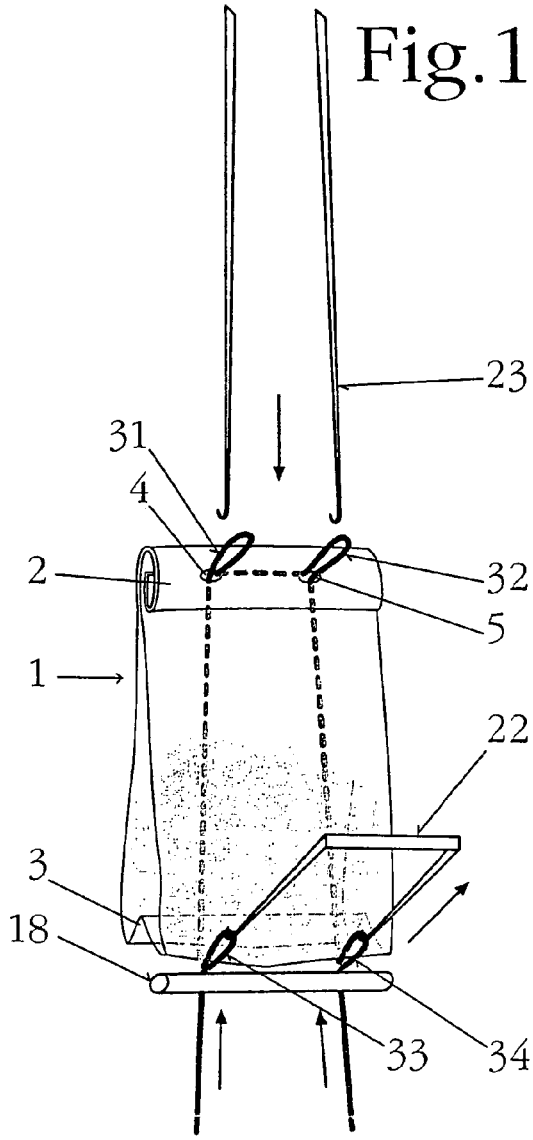
FIG. 10 shows a sample embodiment for forming the loops assigned to the base of the infusion bag in accordance with FIG. 5.
Figure 11:
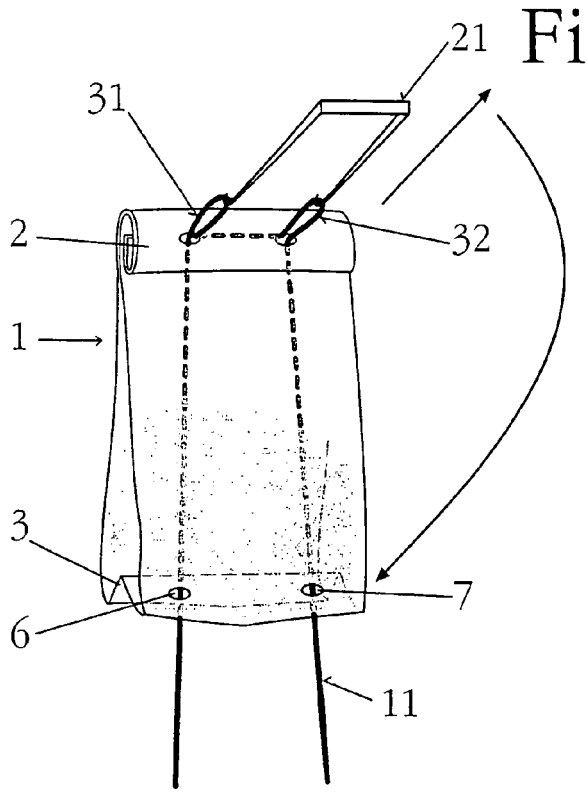
FIG. 11 shows the forming of the loops that pass through the top part in accordance with FIG. 4.
Figure 12:
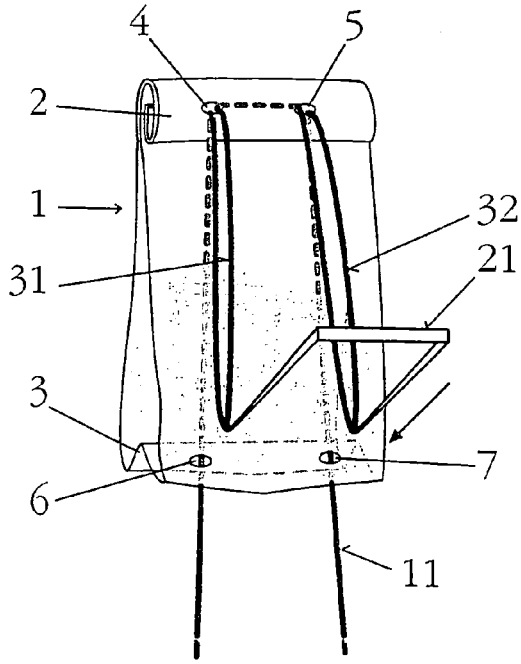
FIG. 12 shows the swivelling of the adjusting element used in the process step shown in FIG. 11.

The loops 33 and 34 assigned to the base 3 of the infusion bag 1 can also, as shown in FIG. 10, be formed with a the help of a roller 18. In this case, the roller 18 is arranged at a distance from the base 3 so that the draw string 11 can be pulled through between the base 3 and the roller 18 with the help of the adjusting element 22. The base 3 of the infusion bag 1 could be equipped with notches in this procedure, in order to prevent the draw string from slipping off.

Figure 13:
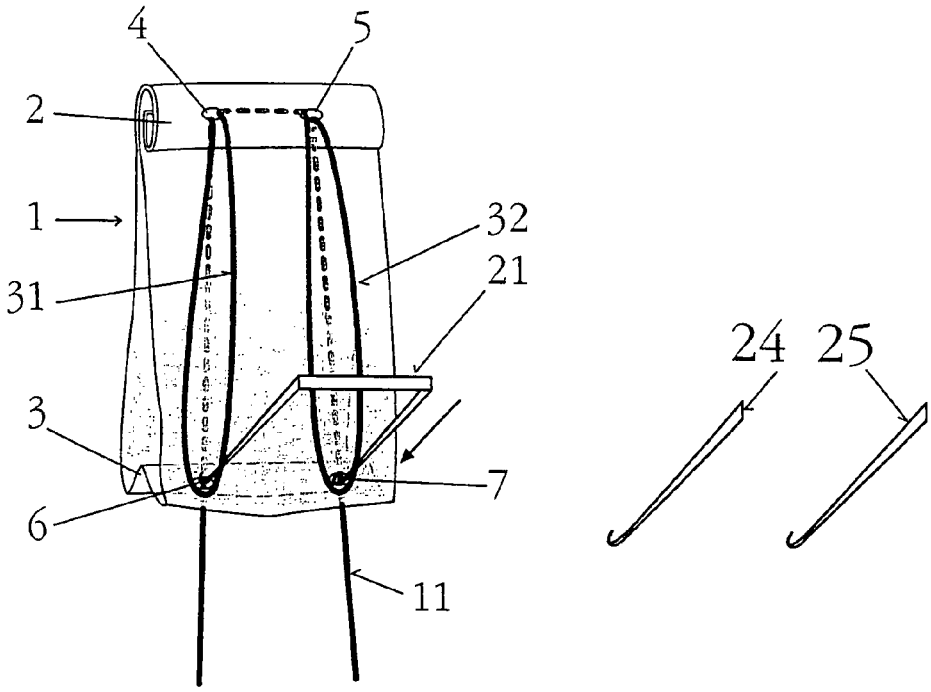
FIG. 13 shows the forming of the loops assigned to the base by means of an adjusting element used in accordance with FIGS. 11 and 12.
Figure 14:
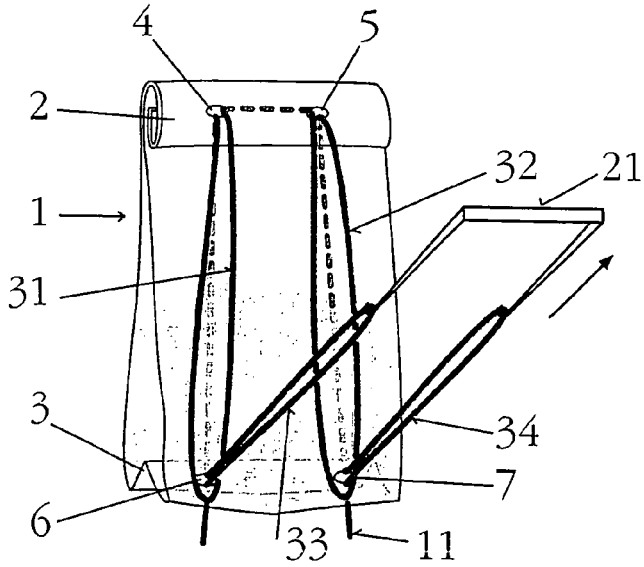
FIG. 14 shows the forming of the loops that pass through the base into draw sections.
Figure 15:
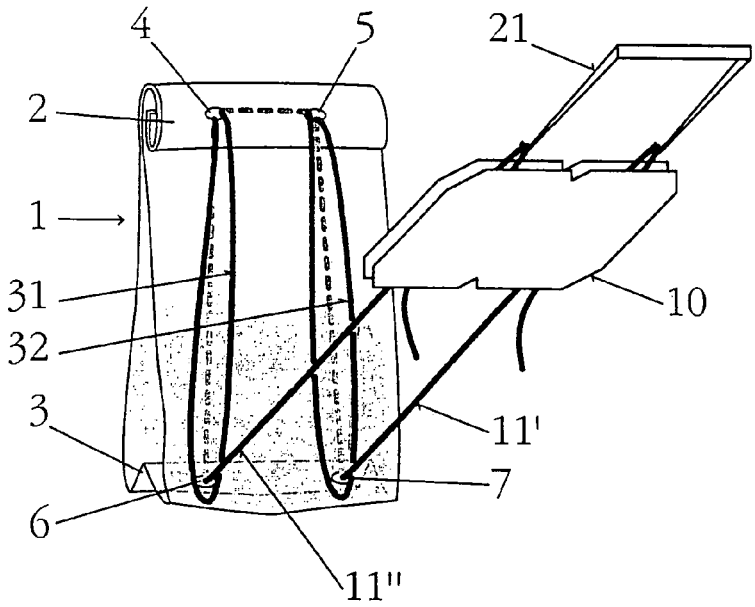
FIG. 15 shows the attachment of a label to the tensioned draw sections.
Figure 16:
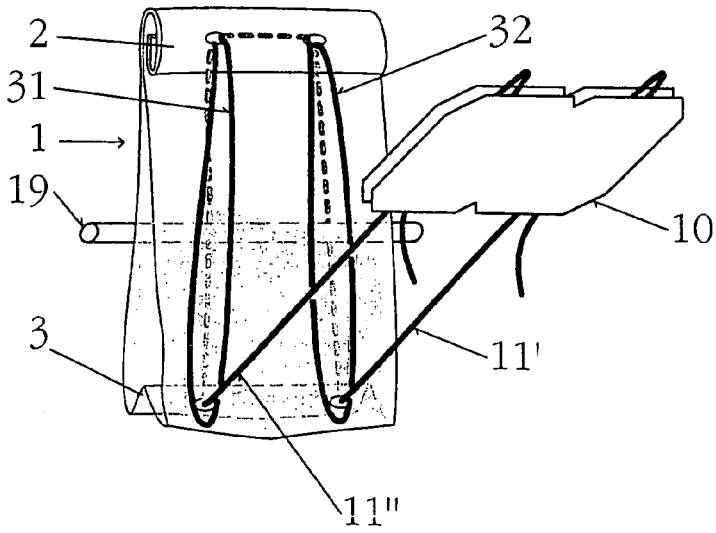
FIG. 16 shows a first process step for tensioning the label.

FIGS. 11, 12, 13 and 14 show that both the loops 31 and 32 and the loops 33 and 34 are to be formed with the help of the adjusting element 21. Once the loops 31 and 32 have been formed, the adjusting element 21 is swivelled in accordance with the line drawn in FIG. 11, so that it is located in front of the openings 6 and 7 and can be passed through these in order to pick up the draw string 11 (FIG. 13). Following the complete or partial pulling up of the loops 33 and 34 through openings 6 and 7 and through loops 31 and 32, the label 10 is attached to the draw sections 11' and 11" (FIGS. 15 and 16).

Instead of the adjusting element 21, as shown in FIG. 13, it is possible for two individual hook needles 24 and 25 to be provided. To prevent any tangles when the hook needles 24 and 25 are being guided back, the needles should be turned inside a space in loops 31 and 32 in such a way that no contact occurs with the draw string 11.

Figure 17:
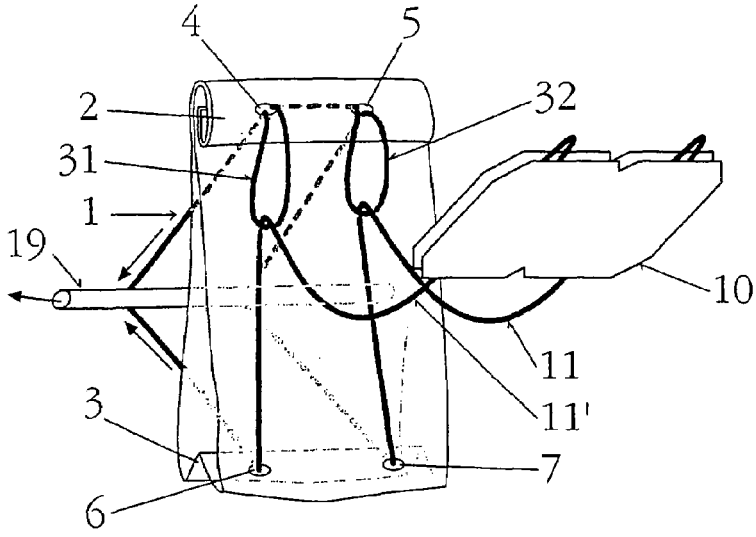
FIG. 17 shows a further process step for tensioning the label.
Figure 18:
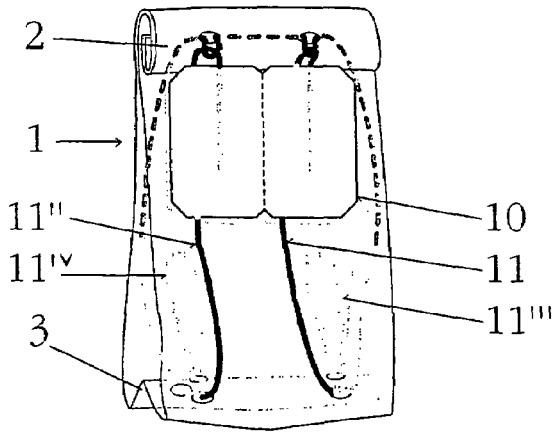
FIG. 18 shows the infusion bag with a label touching the top part and with surplus portions of the draw sections stored in the infusion bag.

So that the label 10 makes contact with the infusion bag 1 when the infusion bag 1 is being transported, as shown in FIG. 18, it is advantageous for surplus parts $\mathbf{11}^{III}$ and $\mathbf{11}^{IV}$ of the draw string 11 to be stored away. As shown in FIG. 16, this is achieved by means of a roller 19 at the back of the infusion bag 1 inserted between the infusion bag 1 and the loops of the draw string 11 and which is moved away from the infusion bag 1, as shown in FIG. 17. The loops 31 and 32 are pulled together in this process and the label touches the top part 2 so that the surplus parts $\mathbf{11}^{III}$ and $\mathbf{11}^{IV}$ of the draw string 11 can be stored in the infusion bag 1.

Figure 19:
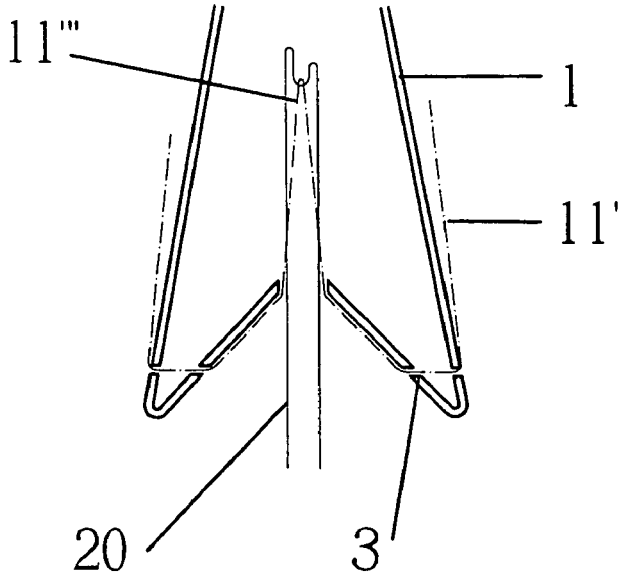
FIG. 19 shows the insertion of the parts of the draw sections to be stored between two chambers of the infusion bag by means of a slider and FIG. 20 shows the insertion of the parts of the draw sections to be stored in an infusion bag by means of a rod.
Figure 20:
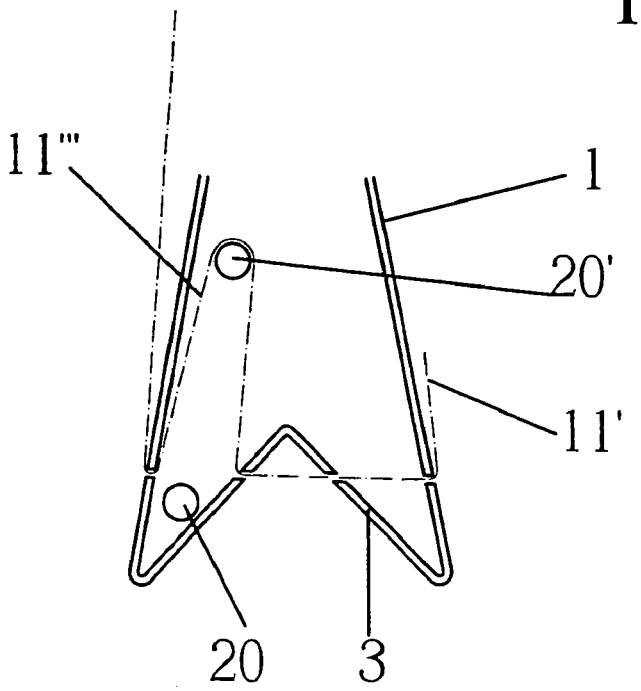

As shown in FIGS. 19 and 20, this is accomplished with the help of a slider 20 or a roller 20'. For this purpose, the slider 20 is pushed through the base 3 of the infusion bag 1 so that the surplus part $\mathbf{11}^{III}$ is inserted between the two chambers (FIG. 19); however, in addition, as shown in FIG. 20, it is possible to use the rod 20' for this purpose, which is inserted into the side of the infusion bag 1 and moved in the direction of the top part 2 in order to store the surplus part $\mathbf{11}^{III}$ of the draw string.

What is claimed is:

1. A method for attaching a draw string to an infusion bag automatically, the method comprising the steps of:

providing the infusion bag with two openings in a top part and two openings in a bottom part of the bag;

providing a slider beneath and on one side of the bag, the slider having a width substantially equal to a lateral distance between the two top openings;

providing two guide rollers between the bottom part of the bag and the slider, the two rollers being arranged laterally with respect to the bag, the guide rollers being located at a distance from each other such that the slider can pass between the two guide rollers;

providing a continuous length of draw string between the guide rollers and the slider;

cuffing the continuous draw string to a selected length;

aligning the cut draw string in a U-shape on the one side of the bag at least to a height of the top openings by drawing the string with the slider and by passing between the guide rollers in the direction of the bag;

inserting the draw string through the top openings to form a loop at each opening on a second side of the bag, wherein the top two loops are connected together by means of an intermediate string portion;

forming another two loops in an area of the bottom part of the infusion bag; and drawing the bottom two loops through the top two loops to surround the bag with the draw string longitudinally in two laterally offset layers and forming draw sections.

2. The method for attaching a draw string to an infusion bag in accordance with claim 1, wherein the U-shape of the draw string is made using the slider adapted to the lateral distance between the two openings provided in the top part of the infusion bag, deflecting the draw string between the two laterally arranged guide rollers in the direction of the infusion bag.

3. The method for attaching a draw string to an infusion bag in accordance with claim 1, wherein the loops assigned to the bottom part of the infusion bag are formed by means of at least one roller arranged at a distance from the bottom part, with the draw string being passed either of through guide elements and in between guide elements and the bottom part of the bag.

4. The method for attaching a draw string to an infusion bag in accordance with claim 3, wherein the loops formed in the area of the bottom part of the infusion bag are formed with a roller as a guide element, the roller being arranged at a distance from the bottom part with each of the draw strings being passed between the roller and the bottom part of the bag.

5. The method for attaching a draw string to an infusion bag in accordance with claim 4, wherein the draw string in the area of the bottom part is guided in cuts formed into the bottom part.

6. The method for attaching a draw string to an infusion bag in accordance with claim 1, wherein the loops assigned to the top part and the bottom part of the infusion bag (1) are each formed by a double needle.

7. The method for attaching a draw string to an infusion bag in accordance with claim 6, wherein the adjusting element used for forming the loops that pass through the top part of the infusion bag is moved to the area of the bottom part, is swivelled, and is released from the top loops and thereafter the bottom loops are formed in the area of the bottom part using the adjusting element.

8. The method for attaching a draw string to an infusion bag in accordance with claim 7, wherein in order to jointly form the loops that pass through the top part and the loops provided in the area of the bottom part, two laterally offset hook needles are provided that, during the forming of the loops in the area of the bottom part, are twisted into a space in the loops assigned to the top part.

9. The method for attaching a draw string to an infusion bag in accordance with claim 1, wherein the loops assigned to the top part of the infusion bag are held in place by an adjusting element during formation of the loops assigned to the bottom part of the infusion bag, the adjusting element, being passed through the loops formed in the top part.

10. The method for attaching a draw string to an infusion bag in accordance with claim 1, wherein draw sections of the draw string are provided with tags in end parts of the draw sections.

11. The method for attaching a draw string to an infusion bag in accordance with claim 10, wherein after the tag has been attached, the draw string surrounding the infusion bag is tensioned in such a way that the tag is in contact with the top part of the infusion bag.

12. The method for attaching a draw string to an infusion bag in accordance with claim 11, wherein surplus parts of the draw string are stored in the infusion bag after the infusion bag has been squeezed, using a selected one of an adjustable slider and a roller.

13. The method for attaching a draw string to an infusion bag in accordance with claim 1, wherein the two loops formed in the area of the bottom part of the infusion bag are guided in a block when the loops are pulled tight.

14. The method for attaching a draw string to an infusion bag in accordance with claim 1, wherein the loops assigned to the bottom part of the infusion bag are formed with the help of two openings worked into the area of the bottom part of the infusion bag.

* * * * *

UNITED STATES PATENT AND TRADEMARK OFFICE

CERTIFICATE OF CORRECTION

PATENT NO. : 7,523,595 B2
APPLICATION NO. : 11/248640
DATED : April 28, 2009
INVENTOR(S) : Paul Gerhard Klar It is certified that error appears in the above-identified patent and that said Letters Patent is hereby corrected as shown below:

Column 5, claim 1, line 21, change “cuffing” to -- cutting --.

Signed and Sealed this

Sixteenth Day of June, 2009

JOHN DOLL
*Acting Director of the United States Patent and Trademark Office*